United States Patent [19]

Taylor, Jr.

[11] Patent Number: 4,965,604

[45] Date of Patent: Oct. 23, 1990

[54] HIGH-POWER HIGH-ISOLATION SWITCH

[75] Inventor: John W. Taylor, Jr., Baltimore, Md.

[73] Assignee: Westinghouse Electric Corp., Pittsburgh, Pa.

[21] Appl. No.: 266,429

[22] Filed: Nov. 2, 1988

[51] Int. Cl.[5] ..... H01Q 3/02

[52] U.S. Cl. ..... 342/374; 455/276; 455/304

[58] Field of Search ..... 342/374; 307/38, 510, 307/262, 154; 333/262; 455/276, 304

[56] References Cited

U.S. PATENT DOCUMENTS 3,959,750 5/1976 Holt ..... 307/259

4,667,201 5/1987 Itoh ..... 342/371

*Primary Examiner*—Thomas H. Tarcza

*Assistant Examiner*—David Cain

[57] ABSTRACT

A high-power high-isolation switch for high-power devices which switch power to one of several alternative output ports. Unwanted leakage is attenuated and high-isolation between the output ports is obtained. In addition, protection against burn-out during abnormally high leakage conditions is provided where the devices employed are not self protecting.

22 Claims, 2 Drawing Sheets

FIG. 3(a)
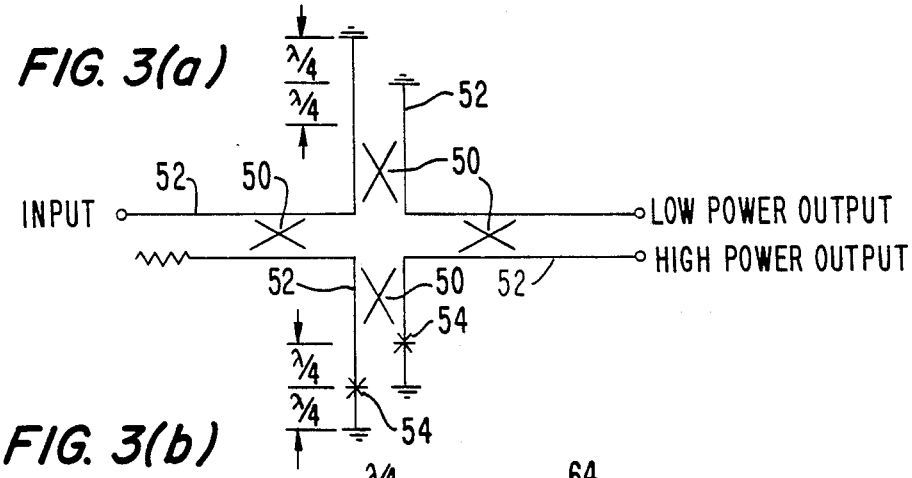
FIG. 3(b)
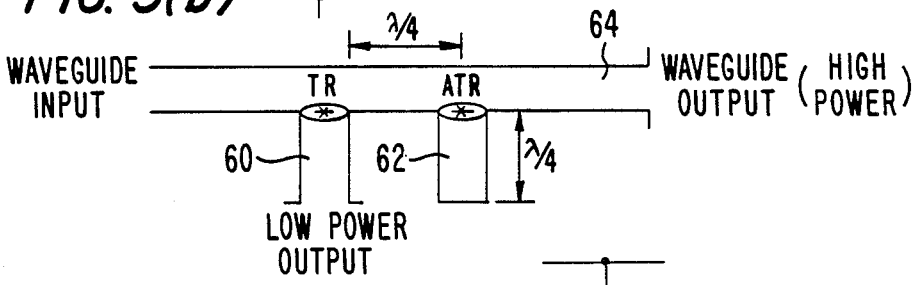
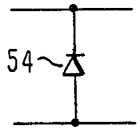
FIG. 5(a)
FIG. 5(b)
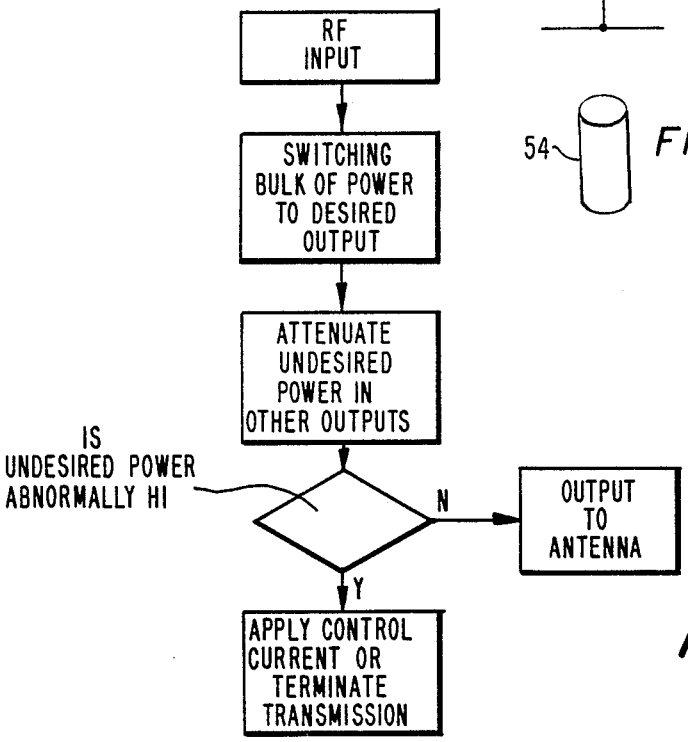
FIG. 4

HIGH-POWER HIGH-ISOLATION SWITCH

CROSS-REFERENCED TO RELATED APPLICATION

This application is cross-referenced to my concurrently filed application U.S. Ser. No. 266,193, filed Nov. 2, 1988, to John Warren Taylor, Jr., entitled "Dual Stacked Beam Radar."

BACKGROUND OF THE INVENTION (1) Field of the Invention

The present invention is directed to a high-power high-isolation switch in which multiple high-power radio frequency (RF) sources which are phase controlled can switch power to one of several alternative output ports, in which the phase-control cannot maintain sufficient isolation of these ports. In addition, protection against burn-out during extraordinary leakage conditions is provided.

(2) Description of the Related Art

In the prior art, diode and gas tube switches are employed in radar systems to allow pulse RF power to be switched to one of a multiplicity of outputs. The diode and gas tube switches, however, are limited by their breakdown voltage and cannot handle high RF power while in a non-conductive state. Ferrite switches can be employed since they have a higher power capability, but generally they are limited to RF frequencies above 2.5 GHz.

In some applications, neither diode nor ferrite switches are feasible. In these cases, the RF power source is usually divided into N sub-units (N being an integer) whose outputs are combined in a matrix of hybrids or similar devices. If the RF amplitudes of the sub-units are maintained to be precisely equal and their output phase relationships are accurately controlled, their power can be made to add in one of the N outputs and cancel in the others. Phase can also be controlled in low power stages of the sub-units by using diodes. However, perfect cancellation in the undesired outputs is not achievable because of inaccuracy in phase and amplitude control. A 20 dB leakage is a typical leakage factor.

The present invention has been developed to overcome the above-mentioned problems of prior art devices.

SUMMARY OF THE INVENTION

An object of the present invention is to provide a device for switching high level RF power between two or more outputs in which unwanted leakage is substantially less than 1% of the power of the desired output.

Another object of the present invention is to provide a device for switching high level RF power between two outputs in which burn-out during high leakage conditions does not occur.

The above-mentioned objects of the present invention are obtained by providing a high-power high-isolation switch including a first switching stage having hybrid means for switching the bulk of the power to a predetermined output and a second switching stage coupled to the first switching stage for attenuating undesired power to the other outputs which have not been selected. The second stage can incorporate devices which conduct high current during their low resistance state but need not hold off high voltage during their high resistance state. Suitable devices include diodes and protective means for preventing burn-out due to leakage or gas filled means for automatically ionizing during the highpower state and not ionizing during the switched state. The gas filled means can be driven by an external current to make ionization more dependable and repeatable, if necessary.

Further, a high-power high-isolation switch is provided which includes control means for switching an antenna beam between low and high elevations, first switching means for receiving an output from the control means and an RF input and outputting high and low signals and second switching means for receiving the low signal from the first switching means and outputting a low beam. Antenna means is provided which is coupled to the first and second switching means and receives the low beam from the second switching means and the high beam from the first switching means. If there is leakage on the low beam, the output from the second switching means will switch to a load rather than the antenna. A second switching means could be included in the path of the high beam, but leakage is not critical in this beam for the disclosed intended application. These objects, together with other objects and advantages which will be subsequently apparent, reside in the details of construction and operation as more fully hereinafter described and claimed, reference being had to the accompanying drawings, forming a part hereof, wherein like reference numerals refer to like parts throughout.

BRIEF DESCRIPTION OF THE DRAWINGS

FIGS. 3A and 3B are circuit diagrams of the second switching means in FIG. 1; and FIG. 4 is a flowchart of the processes provided by the circuits in FIGS. 2, 3A and 3B, with additional means to protect circuits from damage due to failure of the first switching means, if current is applied to the switching means under high power conditions; and FIGS. 5(*a*) and 5(*b*) are diagrams of a diode and gas-tube, respectively, which can be used as the shorting device 54 in FIG. 3(*a*).

DESCRIPTION OF THE PREFERRED EMBODIMENTS

The present invention will be discussed as directed to a radar in which transmitter power is switched between two antenna terminals generating different elevation patterns. Transmission on the low beam illuminates ground and sea creating clutter interference in receivers which listen for echoes from this transmission. In order to suppress this interference, Doppler filters are required for satisfactory performance. The Doppler filters must have a predetermined number of pulses for adequate suppression of the interference. In addition, there must be a number of different interpulse periods in order to fill in blind speeds created by Doppler filtering at a single interpulse period and there must be enough power to overcome any sensitivity problems.

Figure 1:
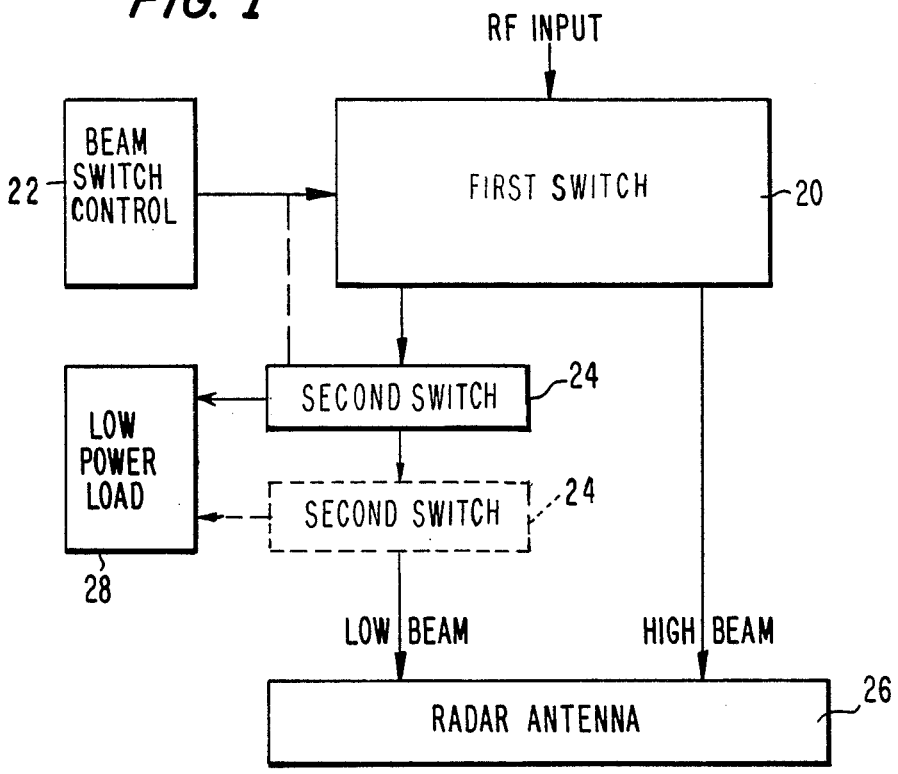
FIG. 1 is a block diagram of a high-power high-isolation switch according to the present invention.

FIG. 1 is a block diagram of the device of the present invention which solves the switch isolation problem by obtaining switch isolation of at least 20 dB. In FIG. 1 a first switching means 20, such as a phase controlled power amplifier, is provided for receiving radio frequency signals and a signal from a beam switch control means 22. The radio frequency signals can be high level radio frequency signals in a range from 30 MHz to greater than 40 GHz.

Figure 2:
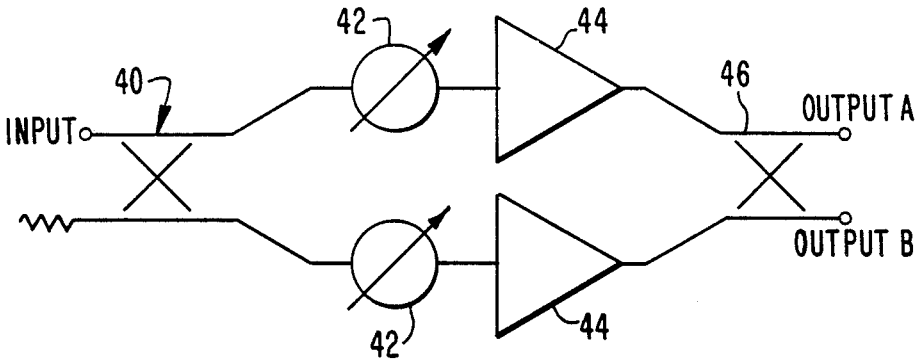
FIG. 2 is a block diagram of the first switching means in FIG. 1.

The first switching means 20 can include a circuit as shown in FIG. 2. A first hybrid 40 receives an input signal and divides the input to phase shifters 42 and power amplifiers 44, respectively. The output from the power amplifiers 44 is then combined in a second hybrid 46 which outputs the signal to either one of two output terminals A or B. Ideally, only one output terminal receives all the signal whereas the other terminal receives none of the signal. However, ideal conditions are difficult to achieve and are rarely obtained. Therefore, a second switching means 24 is provided in FIG. 1 and is connected between the first switching means 20 and a radar antenna 26. The second switching means 24 is a leakage attenuator which receives the low beam from the first switching means 20 and attenuates the leakage from the first switching means 20 when the high beam is transmitting. The second switching means 24 can include circuits as shown in FIGS. 3A and 3B.

In FIG. 3A, the second switching means 24 can include four hybrids 50 in each waveguide 52, and shorting devices 54 such as high-power diodes or gas tubes (see FIGS. 5(*a*) and 5(*b*) which short under a high-power condition as shown. These diodes or gas tubes are inserted into two stubs of one hybrid to shorten the stubs by a quarter wavelength for high power signals. This causes a phase shift of 180° in one of the reflected signals which is added in an output hybrid. Low power signals are switched to the low power output. Alternately, the second switching means 24 can include the circuit shown in FIG. 3B and includes, for example, a transmit-receive gas tube 60 and an anti-transmit-receive gas tube 62 in a waveguide 64 for directly connecting the input and output of the waveguide 64 for high-power signals. Low power signals are switched to a low power output because the gas tubes do not ionize and appear as open circuits rather than short circuits.

A second leakage attenuator similar to those shown in FIGS. 3A and 3B could be included between the first switching means 20 and the radar antenna 26, but is unnecessary in this application since leakage into the high beam has no adverse impact on interference. Although the second switching means 24 must handle high-power, this power exists in only one switching state, i.e., the low beam state.

If solid state diodes are to be used in the second switching means 24, an external control current may be applied prior to and throughout the low beam transmitter pulse to lower the insertion loss and heating of the diodes while they are subjected to high power. No current is applied during high beam transmission because the power on the second switching means 24 is low and leakage power is predominantly directed into a dummy load 28.

To prevent burn-out, if solid state diodes are employed in the device, when a fault in the first switching means 20 causes leakage to be abnormally high, a sensing circuit (not shown) having a very short reaction time, must be included in the device. Tolerable reaction time is dictated by the temperature rise of the diode junction before emergency reaction occurs. Conduction of a solid state diode in this state can be sensed and can cause either a diode control current to be applied or transmission to be terminated.

If a gas tube is used in the second switching means 24 in place of a solid state diode, no control pulses are required since the gas tube is a self-protecting device. The level of the RF power determines whether the gas ionizes. If the expected leakage power from the phase controlled power amplifier is well below the ionization level and the transmitted power is well above the ionization level, the second switching means 24 can operate without external controls. External controls may be desirable, however, to reduce leakage during the leading edge of the pulse or to make ionization more consistent, but they are not a necessary requirement.

Other switching devices which have characteristics similar to gas tubes or solid state diodes, i.e., they switch from high impedance to low impedance as a function of power level, can be employed in the second switching means 24. The main requirement is that the device provide low attenuation in the high-power state and high attenuation in other states, along with protection against damage if conditions in the other states are not as anticipated.

In FIG. 1, although a single second switching means 24 (a leakage attenuator) is shown, a higher degree of isolation can be achieved cascading second switching means 24 (leakage attenuators) as shown by the dotted lines in FIG. 1. However, it should be noted that an increase in insertion loss will occur which must be taken into consideration. The configuration shown in FIG. 1 can typically provide at least 20 dB isolation.

FIG. 4 is a flowchart of the operation of the present invention. An RF signal is input to the first switching means 20 which switches the bulk of the power to a desired output. When the high beam is transmitting, the second switching means 24 attenuates any signal on the low beam. Therefore, all the power is output in the high beam with very little leakage into the low beam. It should be noted that application of this invention is not limited to that of a radar system, but can be used in any other high-power device which requires switching the power to one of a multiplicity of ports with minimal leakage to other ports.

The foregoing is considered as illustrative only of the principles of the invention. Further, since numerous modifications and changes will readily occur to those skilled in the art, it is not desired to limit the invention to the exact construction and application shown and described, and accordingly, all suitable modifications and equivalents may be resorted to, falling within the scope of the invention and the appended claims and their equivalents.

What is claimed is:

1. A high-power high-isolation switch for switching radio frequency (RF) power between two or more outputs, comprising:

first switching means, including:

phase-shifting means for switching the bulk of the RF power to a desired output; and second switching means, coupled to said first switching means, for attenuating undesired power to the other outputs.

2. A high-power high-isolation switch according to claim 1, wherein said second switching means comprises:

external means for supplying a current drive;

diodes, connected to said external means, switched on by current from said external means prior to and during a period that high RF power is obtained from the output of said second switching means; and protection means, connected to said diodes, for preventing burn-out due to leakage.

3. A high-power high-isolation switch according to claim 2, wherein said protection means includes a dummy load connected to said second switching means.

4. A high-power high-isolation switch according to claim 1, wherein said second switching means comprises:

diodes switching from a high to low resistance at a specified voltage level; and protection means, connected to said diodes, for preventing burn-out due to leakage.

5. A high-power high-isolation switch according to claim 4, wherein said protection means includes a dummy load connected to said second switching means.

6. A high-power high-isolation switch according to claim 1, wherein said second switching means comprises:

gas filled means for automatically ionizing during a high-power state and for not ionizing during a switching state.

7. A high-power high-isolation switch according to claim 6, wherein said gas filled means ionizes during the switching state when leakage in said first switching means is abnormally high.

8. A high-power high-isolation switch according to claim 7, wherein said gas filled means is driven by an external current thereby making ionization dependable and repeatable.

9. A high-power high-isolation switch according to claim 1, wherein said second switching means comprises switching means for turning on before a high power input and providing low impedance.

10. A high-power high-isolation switch according to claim 1, wherein a plurality of second switching means are connected in cascade.

11. A high-power high-isolation switch system, comprising:

control means for switching radio frequency (RF) transmitted power between low and high elevation antenna beams;

first switching means, controlled by said control means, for switching a bulk of RF power to one of two output terminals associated with the two antenna beams, a first one of said two output terminals associated with the low elevation antenna beam and second one of said two output terminals associated with the high elevation antenna beam;

second switching means, coupled to said first output terminal of said first switching means for reducing the leakage power on the low elevation antenna beam when the bulk of the power is being radiated on the high elevation antenna beam;

protection means for preventing burn-out due to excessive leakage caused by a fault in said first switching means; and antenna means, coupled to said first and second switching means, for radiating the RF power at high or low elevation angles, respectively.

12. A high-power high-isolation switch according to claim 11, wherein said first switching means including a phase controlled power amplifier.

13. A high-power high-isolation switch according to claim 12, wherein said second switching means including a leakage attenuator.

14. A high-power high-isolation switch according to claim 12, wherein said second switching means includes diodes switched on by a current prior to and during a period when RF power is output.

15. A high-power high-isolation switch according to claim 12, wherein said second switching means includes diodes switching from a higher to a lower resistance at a specified voltage level.

16. A high-power high-isolation switch according to claim 12, wherein said second switching means includes gas-filled devices for automatically ionizing during a high-power state, and for not ionizing during a switching state.

17. A high-power high-isolation switch according to claim 11, wherein said first switching means comprises:

first hybrid means for receiving the bulk of RF power one of said two output terminals associated with the two antenna beams and outputting two signals;

first and second phase shifters, connected to said first hybrid means, for receiving the two outputs signals and outputting phase shifted signals;

first and second power amplifiers, connected to said first and second phase shifters, respectively, for receiving the phase shifted signals and amplifying the phase shifted signals;

second hybrid means, coupled to said first and second power amplifiers, for outputting a first signal or a second signal.

18. A high-power high-isolation switch according to claim 11, wherein the device provides at least 20 dB isolation.

19. A high-power high-isolation switch for switching radio frequency (RF) power between two or more outputs, comprising:

first switching means including hybrid means for switching the bulk of the RF power to a desired output; and second switching means, coupled to said first switching means, for attenuating undesired power to the other outputs, said second switching means comprising:

diode means for switching on and off in accordance with the output of said second switching means; and protection means for preventing burn-out due to leakage, said protection means including:

a dummy load connected to said second switching means.

20. A high-power high-isolation switch, comprising:

control means for switching radio-frequency (RF) transmitted power between low and high elevation antenna beams;

first switching means, controlled by said control means, for switching the bulk of the RF power to one of two output terminals associated with the low and high elevation antenna beams, respectively, said first switching means being a phase controlled power amplifier, said phase controlled power amplifier comprising:

first hybrid means for receiving the bulk of RF power on one of said two output terminals and outputting two signals;

first and second phase shifters, connected to said first hybrid means, for receiving the two output signals and outputting phase shifted signals;

first and second power amplifiers, connected to said first and second phase shifters, respectively, for receiving the phase shifted signals and amplifying the phase shifted signals; and second hybrid means, coupled to said first and second power amplifiers, for outputting one of a first signal and a second signal; and at least one second switching means, coupled to said first switching means, for receiving a first one of said two output signals and outputting a low beam, said at least one second switching means being a leakage attenuator providing at least 48 dB isolation.

21. A high-power high-isolation switch according to claim 20, wherein said second switching means includes diodes switched on by a current prior to and during a period that RF power is output, said high-power high-isolation switch further including protection means, coupled to said second switching means, for preventing burn-out due to abnormally high leakage.

22. A high-power high-isolation switch according to claim 20, wherein said second switching means includes gas filled devices for automatically ionizing during a high-power state, and for not ionizing during a switching state.

* * * * *